US010119707B2

(12) United States Patent
Punzel et al.

(10) Patent No.: US 10,119,707 B2
(45) Date of Patent: Nov. 6, 2018

(54) TELESCOPING DOWNDRAFT VENTILATOR ALIGNMENT ASSEMBLY

(71) Applicant: Western Industries, Inc., Watertown, WI (US)

(72) Inventors: William H. Punzel, Edgerton, WI (US); Christopher R. Irgens, Brookfield, WI (US); Peter F. Sosso, Janesville, WI (US)

(73) Assignee: Western Industries, Inc., Watertown, WI (US)

( * ) Notice: Subject to any disclaimer, the term of this patent is extended or adjusted under 35 U.S.C. 154(b) by 198 days.

(21) Appl. No.: 14/584,556

(22) Filed: Dec. 29, 2014

(65) Prior Publication Data

US 2015/0198337 A1 Jul. 16, 2015

Related U.S. Application Data

(60) Provisional application No. 61/927,559, filed on Jan. 15, 2014.

(51) Int. Cl.
*F24C 15/20* (2006.01)

(52) U.S. Cl.
CPC ..... *F24C 15/2042* (2013.01); *F24C 15/2078* (2013.01)

(58) Field of Classification Search
CPC ..... F24C 15/2078; F24C 15/2042
USPC ..... 126/299 R, 299 F, 299 D
See application file for complete search history.

(56) References Cited

U.S. PATENT DOCUMENTS

| | | | | |
|---|---|---|---|---|
| 8,020,549 | B2 * | 9/2011 | Huber | F24C 15/2042 126/299 D |
| 2006/0278215 | A1 * | 12/2006 | Gagas | F24C 15/2092 126/299 D |
| 2007/0001562 | A1 * | 1/2007 | Park | A47B 88/467 312/333 |
| 2009/0137201 | A1 * | 5/2009 | Huber | F24C 15/2092 454/284 |

* cited by examiner

*Primary Examiner* — Vivek Shirsat
(74) *Attorney, Agent, or Firm* — Boyle Fredrickson, S.C.

(57) ABSTRACT

A telescoping downdraft ventilator with a system for self-aligning a vent within a housing is provided. The telescoping downdraft ventilator of the present invention comprises a housing with a side panel that includes a channel, a vent sized to fit within the housing, a drive assembly that moves the vent along the channel, and a guide attached to the vent for engaging the channel, wherein the guide is operably coupled with a biasing element. In one embodiment, a pair of guides is respectively coupled with a pair of springs and is positioned on opposite sides of the vent along a line that is substantially perpendicular to a pair of channels.

19 Claims, 7 Drawing Sheets

TELESCOPING DOWNDRAFT VENTILATOR ALIGNMENT ASSEMBLY

CROSS REFERENCE TO RELATED APPLICATIONS

This application claims priority to U.S. Provisional Application No. 61/927,559 filed on Jan. 15, 2014 the entire contents of which are expressly incorporated by reference herein.

BACKGROUND OF THE INVENTION

1. Field of the Invention

The present invention relates in general to the field of downdraft ventilators for use in conjunction with a cook top. More particularly, the present invention relates to a telescoping downdraft ventilator assembly having a system for self-aligning a moveable vent within a housing.

2. Discussion of the Related Art

Telescoping downdraft ventilators are well known to those skilled in the art. A conventional telescoping downdraft ventilator typically includes a housing, e.g., usually positioned behind a cook top, and a vent that is extendable above the housing to remove contaminated air from a cook top. When not in use, the vent is usually stored in the housing below the cook top. Further, the ventilator typically includes a fan for moving an through the system and a drive assembly for raising and lowering the vent with respect to the housing.

One problem with prior designs is that oftentimes the vent is not centered within the housing. This may occur if the vent is not evenly balanced, or if the lifting force provided by the drive assembly is uneven. Thus, undesired friction and/or resistance may occur between the vent and the housing or other components when raising and lowering the vent, which may in turn cause excessive wear and tear on the drive assembly and/or other components eventually leading to failure of the components and inoperability of telescoping downdraft ventilator. Additionally, debris can easily become lodged between the vent and the housing which can cause binding, resisting the telescoping action.

Another concern with prior designs is side-to-side vent stability. Poor side-to-side stability is often perceived as poor quality in the field. To resolve side-to-side motion concern, springs have been integrated into a guide. These springs take up the vent to chassis clearance locally adding sufficient preload to the chassis rail to stabilize the chimney from wobbling during raising or retracting.

What is needed therefore is a system for use in conjunction with a telescoping downdraft ventilator that centers the vent within the housing and reduces undesired friction, side-to-side movement, and resistance during the raising and lowering operation.

SUMMARY AND OBJECTS OF THE INVENTION

By way of summary, one object of the present invention is to provide a telescoping downdraft ventilator having a system for centering or aligning the vent within the housing.

Another object of the present invention is to reduce degradation of the drive assembly by providing a smoother raising and lowering operation. A still further object of the invention is to provide a downdraft ventilator having a system that can accommodate for uneven top and/or side loading forces. Yet another object of the present invention is to provide an apparatus that has one or more of the characteristics discussed above but which is relatively simple to manufacture and assemble using a minimum of equipment.

In accordance with one aspect of the present invention, these objects are achieved by providing a telescoping downdraft ventilator with a housing having a side panel with a channel. A vent is dimensioned to fit within the housing. A drive assembly is operably coupled with the vent and a guide is attached to the vent for engaging the channel. The guide is operably coupled with a bias element that biases the guide away from the channel.

In accordance with another aspect of the present invention, these objects are achieved by providing a telescoping downdraft ventilator that has a housing, a vent sized to fit within the housing, and a drive assembly for vertically moving the vent with respect to the housing. The vent is preferably biased toward the center of the housing In accordance with a further aspect of the present invention, the telescoping downdraft ventilator has a housing having a first side panel with a first channel and a second side panel with a second channel on opposite sides of the housing. Here, the side panels and channels are substantially parallel to one another. A vent is configured to travel along the first and second side panels. For example, a first guide and a second guide are attached to opposite sides of the vent. The first guide engages the first channel and the second guide engages the second channel. Further, the first guide and second guide are aligned along a line substantially perpendicular to the first side panel and first channel, and the second side panel and the second channel as well as each guide is held in with a bias from a spring.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1A:
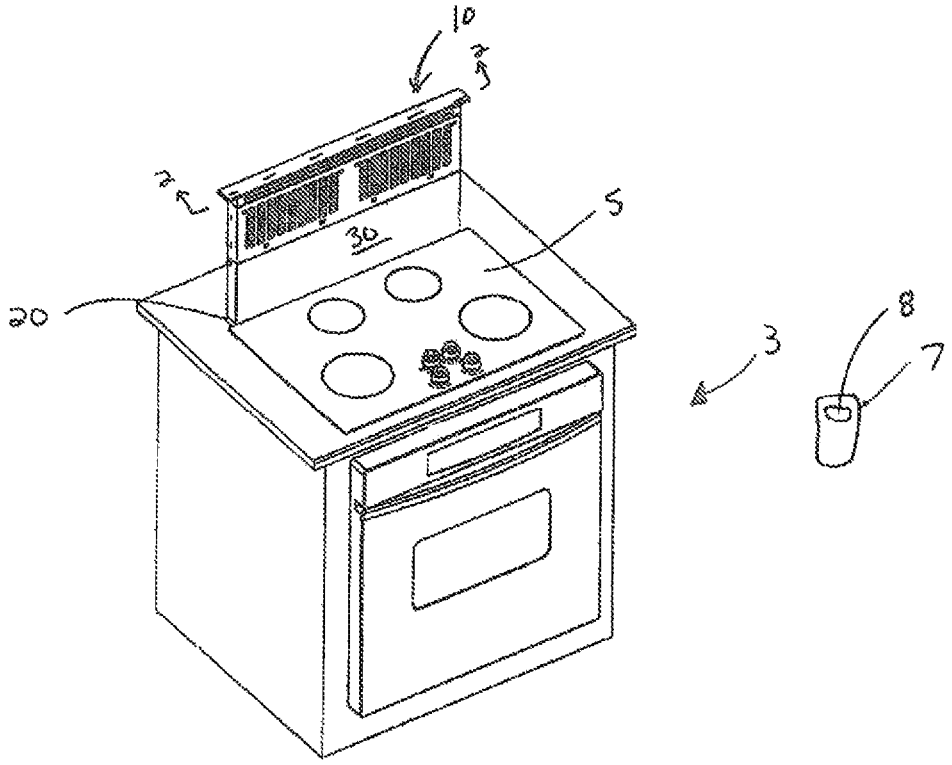
FIG. 1A illustrates a telescoping downdraft ventilator of the present invention coupled to a cook top.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF EMBODIMENTS

The present invention and the various features and advantageous details thereof are explained more fully with reference to the non-limiting embodiments described in detail in the following description.

1. System Overview

The telescoping downdraft ventilator of the present invention generally includes a system that centers or aligns the vent within the housing. This is preferably accomplished by using one or more guides that are biased away from the housing, e.g., by employing springs. More preferably, the guides are aligned along a line that is substantially perpendicular to the direction of movement of the vent. Thus, the force exerted by the springs on either side of the vent centers the vent within the housing. This centering or self-aligning effect is desirable because it facilitates a smoother raising and lowering operation, which may in turn reduce the amount of resistance experienced by a drive assembly and thus increase the lifespan of the drive assembly.

The fixed guide relies on a "controlled clearance" of a shoe on each side of the chassis side panel. The result is reduced nominal system friction and reduced frictional variability. The springs on the guides remain in constant contact with the side panels, but are of small size, reducing the contact surface. This means that the guides bump and deflect off channels in the side panels with the small surface contact of the springs and the controlled clearance.

This limited contact occurs if the vent should be inadvertently contacted by a person or object, or if there is a slight misalignment during product construction. In any account, the fictional loads are reduced since the guides only partially contact the side panels. As a result, periodic and chronic stoppages (straight line or tilted) are eliminated, tilting of the vent during raising or lowering is eliminated, and tighter control of side loads is achieved. The result is an overall (actual-functional and perceived-aesthetic) improvement in quality for vent raising and lowering.

Testing has confirmed that lubrication is not needed with the vent cut side panels, or guides. The elimination of lubrication thus lowers manufacturing costs, field servicing, and resists field contamination by foreign debris as may be attracted by or adhered to the lubricant.

As the guides are one piece, they offer the advantages of easing assembly, component reduction, and lower overall product manufacturing cost. The guide configuration engages the inner side panel surface for increased stability in the horizontal plane and with respect to controlling the motion of angularity.

Engaging sections extend from the guide shoes and into channels on the side panels. The engaging sections do not make contact at the bottom of the channel, but on the tapered sides of the channel providing fore and aft displacement control. The engaging sections are designed to allow for a controlled clearance with the channel and also in intermittent contact as the vent extends and retracts.

The guides contact surfaces form "stops" that act as a controlled clearance to the side panels. The engaging sections come into contact with the channels on the side panels intermittently, should an outside load result. If such an outside load occurs, the engaging sections will experience the majority of the applied load preventing the springs on the guides from excessively bending or being damaged. The stops prevent the springs from over-extending. As the outside load is removed from the vent, the springs will re-center the vent to its desired position and the stops will not contact the side panel.

The spring load of the spring features will vary depending on manufacturing tolerances and the resultant guide to channel. The magnitude and variability of this spring load has less of an influence on the required lift/retract loads as compared to previous designs. The springs of the inventive design are in normal/perpendicular force contact with the mating inner rail surfaces.

The guide design maintains the same channel design as disclosed in U.S. Pat. No. 8,020,549 issued on Sep. 20, 2011, the entire contents of which are expressly incorporated by reference into the present specification. While the previous rail design is maintained, any other side panel and channel may be used with the guides. The inventive guide may also be retrofitted into existing side panels or other channels.

The guides may be made of various materials and processes. Preferably, the guides are manufactured out of a single piece of injection-molded plastic shoe made of Teflon, Delrin, Acetal, etc.

The fixed guide design discussed above provides improved test performance over previous designs, 14,000 cycles of operation without permanent/significant loss of function or frequent stoppages have been measured with the inventive design whereas previous designs commonly experience anywhere from 2-10 stoppages within these 14,000 cycles and some tilting of the vent during deployment after a period of time.

The inventive design surpasses 64,000 cycles in lab testing without stoppage. This inventive design neither requires lubrication nor the use of a controlled side panel material, such as a specific alloy or surface finish, with specific or controlled frictional characteristics as required with existing designs. This inventive design allows for more consistent lift and retraction loads allowing better control of maximum permissible lift/retract forces, as required in the field. Also the loads on the lift motor assembly are reduced improving the service life of the assembly. The net outcome of the inventive design is overall a more robust and consistent design/product.

2. Detailed Description of Embodiments

Figure 1B:
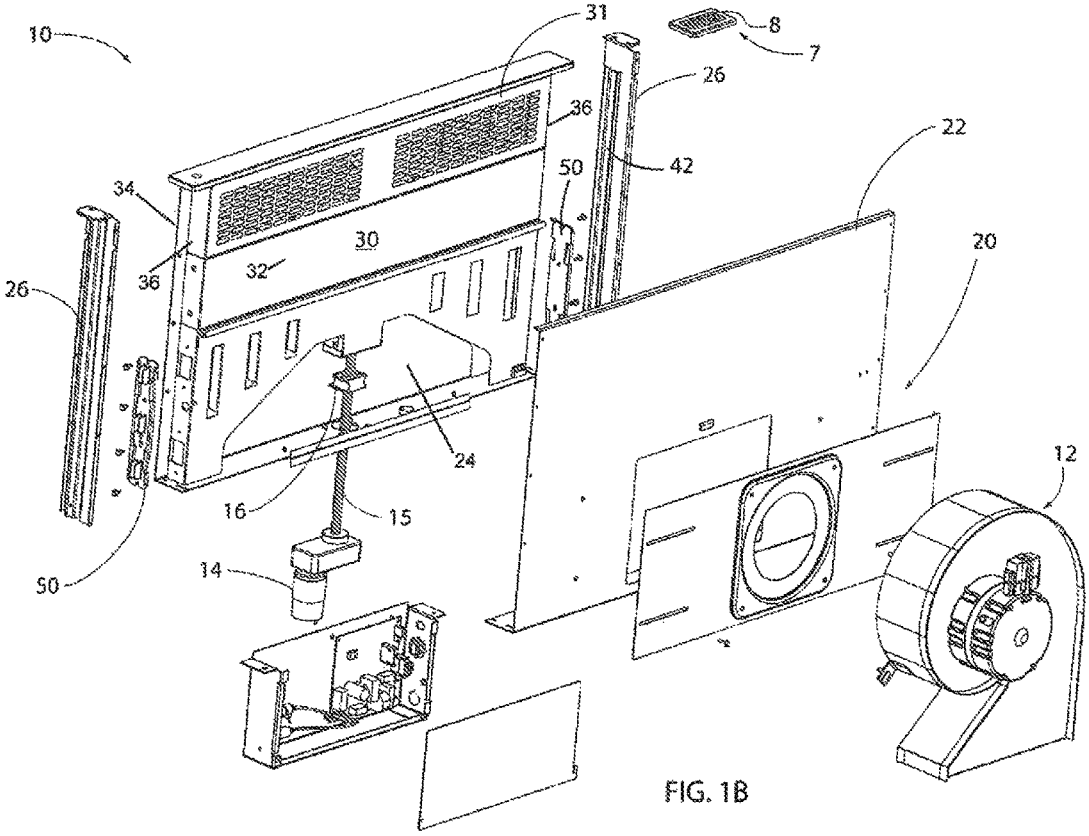
FIG. 1B illustrates an exploded perspective view of one embodiment of a telescoping downdraft ventilator of the present invention.
Figure 2:
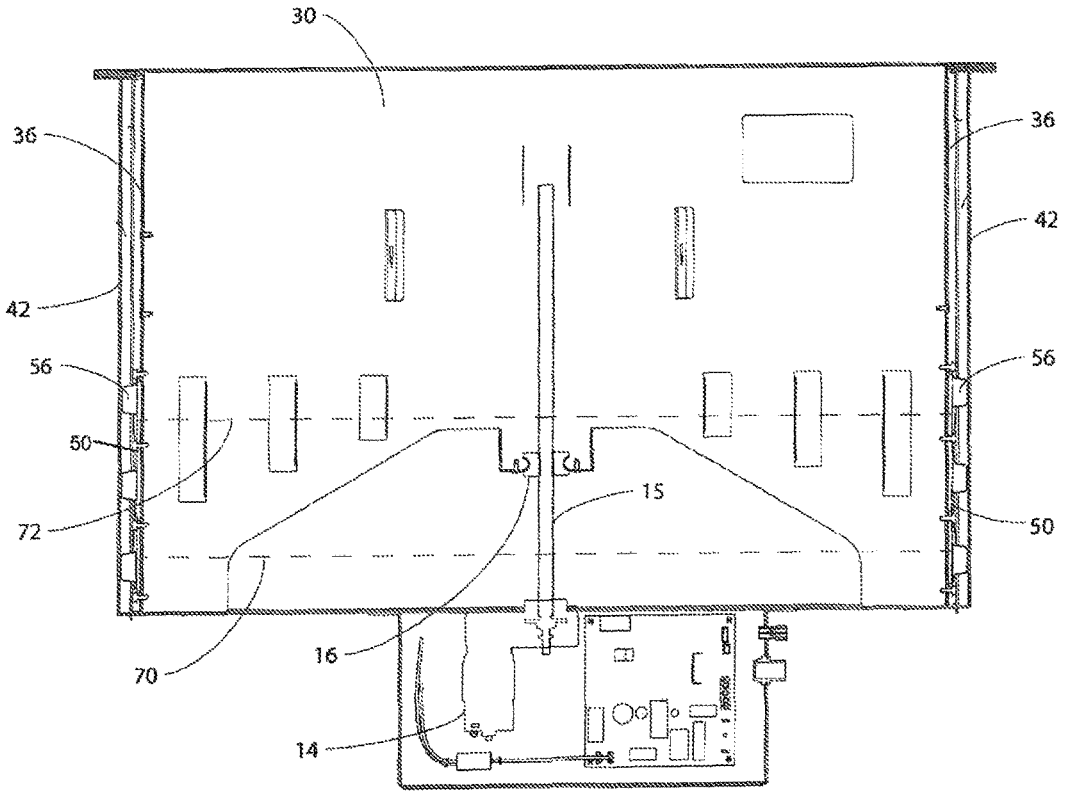
FIG. 2 illustrates a cross-sectional view of the downdraft ventilator of the embodiment of FIG. 1A along the line 2-2 of FIG. 1.

The present invention and its components are shown in FIGS. 1A-7. A self-aligning telescoping downdraft ventilator 10, in accordance with the present invention, is shown in FIGS. 1A-2 attached to a stove 3 and having a cook top 5. A remote control 7 with a screen 8 may be provided for remotely controlling the up and down movement of the ventilator 10. A standard telescoping downdraft ventilator 10 that typically includes a housing 20 with a movable vent 30 is well known to those skilled in the art. See, e.g., pending applications U.S. Ser. Nos. 11/120,124 and 11/838,621, the entire contents of which are expressly incorporated by reference herein. Therefore, a detailed description thereof is not necessary to fully understand the present invention, which is directed to novel improvements in an alignment system for centering the vent 30 within the housing 20.

Referring now to the drawings, FIGS. 1B and 2 show one embodiment of the telescoping downdraft ventilator 10 of the present invention. Generally speaking, the downdraft ventilator 10 comprises a housing 20 and a vent 30 that fits within the housing 20. The vent 30 typically contains one or more fans 12 for drawing air into the system, moving air through the system and exhausting air out of the system.

The housing 20 preferably has a front panel 22, a rear panel 24 and two side panels 26. These components may be integral with the housing 20 or more preferably, they may be separate components secured together using any suitable fastener, e.g., bolts, rivets, or screws. The front panel 22, rear panel 24 and side panels 26 preferably combine to form a housing 20 having a rectangular cross section, with the length preferably being substantially greater than the width. In one embodiment, the housing preferably has a height of about 24 inches, a width of about 30 inches, and a depth of about 2 inches. Such dimensions allow for positioning the housing 20 between a cook top and a wall, which is a typical configuration for a downdraft ventilator 10. See FIG. 1A. The housing 20 may be constructed of any suitable material, and preferably it is made from galvanized steel.

Figure 6:
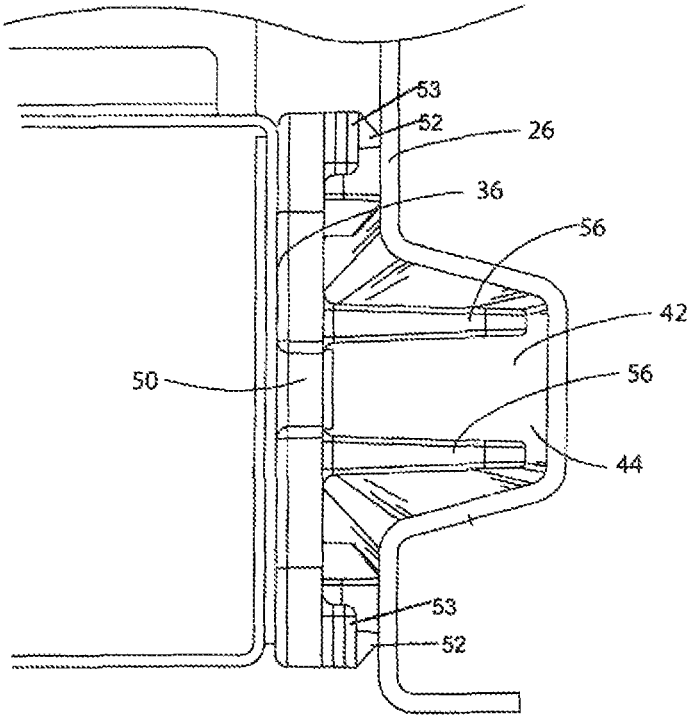
FIG. 6 illustrates a top view of a guide and a channel of the embodiment of FIG. 1B.

As shown in FIG. 1*b* and as well as in FIG. 6, the side panels 26 of the housing are configured to form channels 42. The channels 42 are substantially parallel to one another and are substantially perpendicular to the front panel 22 and rear panel 24 of the housing 20, i.e., to the generally rectangular cross-section of the housing 20. Alternatively, each channel 42 may be a separate structure attached to a side panel 26 of the housing. However, as shown in FIG. 6, it is preferred that the channels 42 are formed by the side walls 26, which may reduce the amount of material needed to form the housing 20, eliminate manufacturing steps, and lower the cost of production. A variety of materials may be used to form the channel 42, and preferably it is made from stainless steel.

Each side panel 26 includes a channel 42 for guiding the vent 30 as it is raised and lowered with respect to the housing 20. The channel 42 may be any shape that will help to guide the vent 30 within the housing 20, e.g., as shown in FIG. 6, the channel 42 preferably has a trapezoidal cross-section. This preferred shape for the channel 42 may provide for some slight lateral movement of the vent 30 while it is being raised and lowered, which may in turn allow for a smoother raising and lowering operation. The inner surface 44 of the channel 42 is preferably smooth to minimize resistance or friction while the vent 30 is raised or lowered. The channel 42 is preferably not lubricated on the inner surface 44 which prevents debris such as flood particles, or any other particles, and dust from being attracted to the lubricant which increases resistance or friction.

As shown in FIG. 1B, the vent 30 is preferably comprised of a front wall 32, a rear wall 34 and two opposing side walls 36. As with the housing 20, these vent components may be integral with the vent 30 or, more preferably, they may be separate components secured together using any suitable fastener, e.g., bolts, rivets, or screws. The vent 30 is sized to fit within the housing 20, i.e., the vent 30 is substantially contained within the housing 20 while not in use. However, the vent 30 partially extends out of the housing 20 and over the cook top 5 when the ventilator 10 is in use. See, e.g., FIG. 1A. The vent 30 preferably has a height of about 9 inches to about 15 inches, a width of about 29 inches, and a depth of about 1½ inches.

As mentioned, the vent 30 is configured to engage the channels 42, which guide the vent 30 as it is moved, e.g., raised and lowered, with respect to the housing 20. Preferably, as shown in FIG. 2, the vent 30 has two guides 50 adjacent a respective side wall 36 for engaging the channels 42 within the housing 20, i.e., each side wall 36 is coupled with a guide 50 for engaging one of the channels 42. Each guide 50 has a shape that is complementary to the shape of the channel 42 to preferably provide a close fit between the guide 50 and the channel 42 while still allowing for relatively easy movement of the guide 50 through the channel 42. The guide 50 may be made of any suitable material, and preferably it is made from a smooth, hard plastic, e.g., Acetal or Delrin.

Each guide 50 is biased away from the channel 42 and toward the center of the vent 30, e.g., the guide 50 is preferably biased toward the vertical centerline of the vent 30 in a substantially perpendicular to the channels 42. Thus, by positioning a pair of guides 50 along a line 70 that is substantially perpendicular to the channels 42, the pair of guides 50 will help to vertically align the vent 30 within the housing 20, i.e., the system will be self-aligning. Additional guides 50 may be arranged in pairs as described above.

Figure 4:
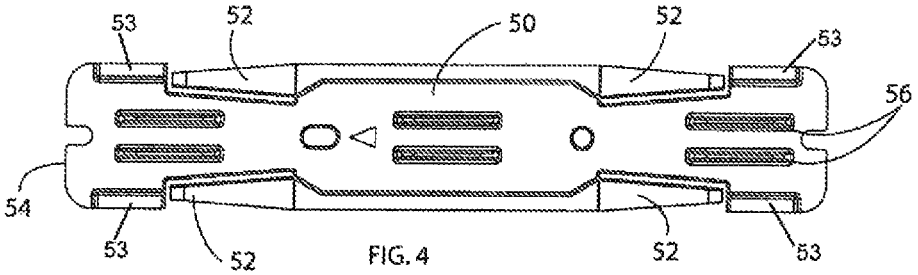
FIG. 4 illustrates a cross-sectional view of the guide assembly of FIG. 3.
Figure 5:
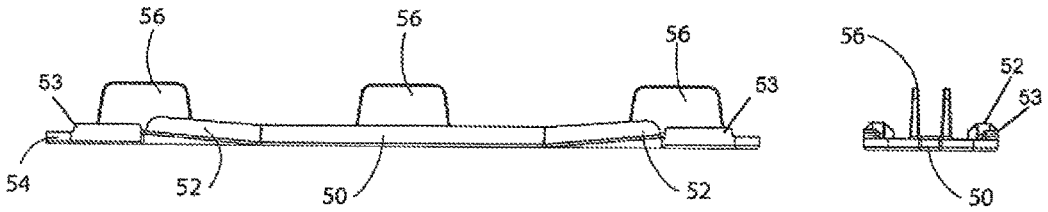
FIG. 5 illustrates a front view of the guide assembly of FIG. 3.

The preferred biasing element for each guide is a biasing dement that forms a spring 52, shown in FIGS. 4 and 5. The spring 52 is configured with the guide 50 and the vent 20 so that the spring 52 exerts a force on the guide 50 that is substantially perpendicular to the side wall 36 of the vent 30 and toward the channels 42 of the side panels 26 of the housing 20. The spring 52 is incorporated in the guide 50 and is formed of a finger-like biasing member that is slightly raised from the guide 50 forming a cantilevered spring much like a leaf spring. While any spring may be used a cantilevered spring is the preferred spring and all references to a spring herein refer to a cantilever spring.

The springs 52 also act as cleaning devices removing debris. Should any debris such as dust, grease, or other objects become lodged between the side panels 26 and guides 50, the springs 52 lift and remove the debris, pushing it away front the area and ensuring smooth telescoping action. Prior designs have been more prone to binding as the fit between guides and side panels were of closer tolerances and also required debris-attracting lubrication.

The preferred configuration of the guide 50 is shown in FIGS. 3-6. In the preferred configuration, the guide 50 is comprised of two sections, i.e., a base section 54 and an engaging section 56. The engaging section 56 passes through the inner surface 44 of the channel 42 with minimal contact as opposed to previous designs which had significantly more contact between the engaging sections and channels. The base section 54 and the engaging section 56 are preferably integral with the guide 50, though they may be separate components that are secured together to form the guide 50. The base section 54 also includes stops 53 that limit the amount of travel the springs 52 may make. When the springs 52 arc deflected by contact with the side panel 26, best shown in FIG. 6, the stops 53 provide a positive stop for any movement. After the side load is removed, the springs 52 re-center the vent 30 between the side panels 26 by applying equal and opposite side forces on both sides of the vent 30.

The engaging section 56 of the guide 50 is the portion of the guide 50 that engages the channels 42, as shown in FIGS. 5 and 6. As discussed above, in the preferred embodiment, the engaging section 56 is shaped to closely fit within the channel 42 of the side panels 26. Preferably, the engaging section 56 of the guide is generally flat and parallel with two raised extensions as best seen in FIG. 6. Also shown in FIGS. 3-5, the engagement section 56 has multiple flat sides forming the generally flat and parallel shape of the engagement section 56. As shown in FIG. 6, the engaging section 56 of the guide 50 preferably has a profile that is generally flat in shape, and it contacts the sides of the channel 42. The engaging sections 56 do not contact the base of the channel 42. As the channel 42 is tapered and the engaging sections 56 are straight and parallel, only a small portion of the engaging sections 56 make contact with the channel 42 thus minimizing frictional drag.

Figure 3:
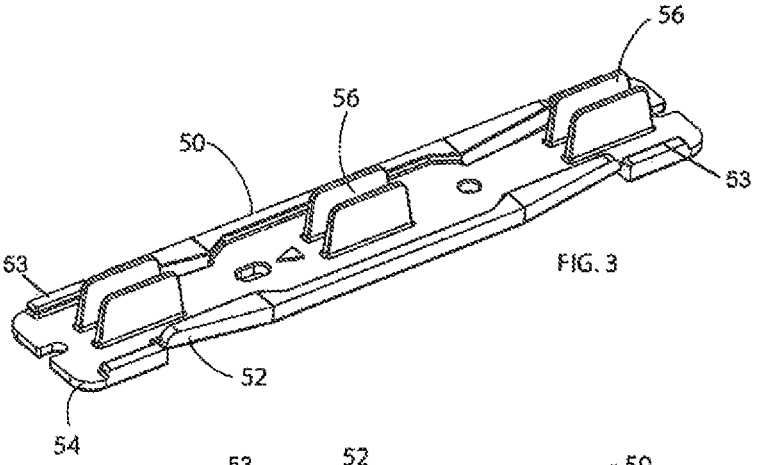
FIG. 3 illustrates an exploded view of a guide assembly of the telescoping downdraft ventilator of the present invention.

The engaging section 56 preferably are formed in pairs that may make incidental contact in the channel 42, seen in FIGS. 3-5, that help to secure the guide 50 within the channel 42 of the side panels 26, as shown in FIG. 6. The springs 52 keep the vent 30 in compression on both sides by exerting equal and opposite force towards the center of the vent 30 in opposing directions, thus limiting any side-to-side motion.

Figure 7:
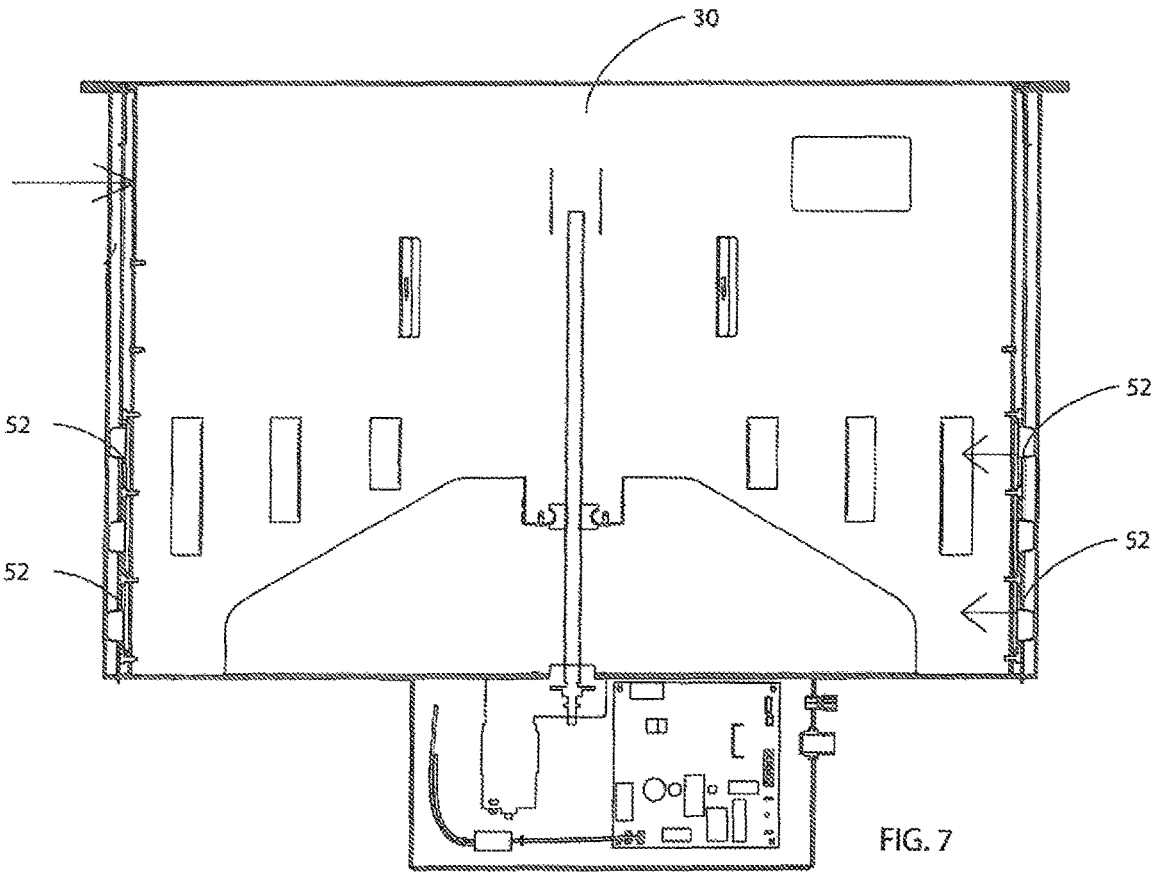
FIG. 7 illustrates a cross-sectional view of the embodiment of FIG. 1B and shows a potential force distribution with respect to the vent.

As a result, in operation, when a force is exerted on the vent 30, e.g., a force that is generally normal to the side walls 36 of the vent 30, the guides 50 on either side of the vent 30 will move with respect to the channels 42 causing the springs 52 to compress, which biases the vent 30 toward the center of the housing 20 and thus helps center the vent 30 within the housing 20. See FIG. 7, with threes indicated by arrows. The force from the left, as shown in FIG. 7, loads the top right spring and also the bottom left. The movements created resist the side force and help to center the vent 30, particularly when the vent is in motion. When the vent 30 hits the top or bottom stops, it will realign itself within the housing 20.

Moreover, for forces that are not substantially normal to the vent 30, the preferred trapezoidal shape of the channel 42 and the flat and parallel shape of the engagement section 56 of the guide 50 will help to normalize those forces and center the vent 30 within the housing 20.

If additional pairs of guides 50 are desired, the guides 50 are preferably positioned so that the forces exerted by the spring are substantially offsetting, i.e., aligned along a line that is substantially parallel to the channels 42. This system may be described as a "floating system".

In another embodiment of the telescoping downdraft ventilator 10 of the present invention (not shown), the position of the guides 50 and the channels 42 may be switched, i.e., the channels 42 may be positioned on the side walls 36 or may be integral with the side walls 36 of the vent 30, and the guides 50 may be positioned on the side panels 26 of the housing 20.

In still another embodiment (not shown), the channels 42 may be inverted, e.g., the channel 42 forms a ridge that extends toward the vent 30. In such an embodiment, the engaging section 56 of the guide 50 would have a channel contoured to receive the ridge of the channels 42.

As discussed above, the vent 30 is movable with respect to the housing 20, e.g., the vent may be raised above the cook top to remove undesired gases from the cook top when the cook top is in use, and the vent 30 may be lowered when the cook top is not being used. The vent 30 may be raised and lowered manually or preferably with a drive assembly 14, e.g., a motor.

Any one of a variety of known configurations may be used to raise and lower the vent 30. For example, in the preferred embodiment, the lift assembly includes a motor 14 having a threaded shaft 15 extending substantially vertically. The shaft 15 engages a nut 16 secured to the vent 30 so that rotating the shaft 15 in one direction raises the vent 30 and rotating the shaft 15 in the other direction lowers the vent 30. In another configuration (not shown), the motor has a threaded shaft that extends generally horizontally and engages a scissor-type linkage for raising and lowering the vent. A further discussion of the scissor-type linkage may be found in U.S. application Ser. No. 11/838,621, the entire contents of which are expressly incorporated by reference herein.

The telescoping downdraft ventilator 10 of the present invention may further include an electronic control system for controlling, for example, the fan 12 and the drive assembly 14, which is discussed in detail in application Ser. No. 11/838,621. The ventilator 10 may further include sensors in communication with the electronic control system for detecting one or more conditions within the vent or housing.

For example, a load sensor may detect excess load in the drive assembly 14, e.g., caused by an item obstructing either the raising or lowering of the vent with respect to the housing. Preferably, the load sensor would stop the drive assembly 14 when detecting a force when raising the vent and when lowering the vent. As there is limited contact between the engaging section 56 and the channels 42, a decreased amount of three is necessary to move the vent 30. This allows for smaller and quieter motors to be used than in the prior art.

An added benefit of the present invention is that the guides 50 may be retrofitted into previous telescoping downdraft assemblies that utilize the same side panels 26 channels 42. As there is much less friction and force needed to move the vent 30 in the inventive assembly, unique programming is necessary as obstructions will pose unique readings to any load sensors.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

We claim:

1. A telescoping downdraft ventilator comprising:

a housing having a side panel with a channel;

a vent dimensioned to fit within the housing and movable along a path of travel;

a drive assembly operably coupled with the vent; and a guide attached to the vent for engaging the channel, the guide comprising:

a base section; and an engaging section comprising at least one pair of raised parallel extensions such that there is a gap between each raised parallel extension in each pair of raised parallel extensions;

wherein the guide is coupled with a bias element that biases the engaging section away from the channel and wherein the bias element applies a biasing force on the guide that is perpendicular to the path of travel of the vent.

2. The telescoping downdraft ventilator of claim 1, further comprising:

a second channel within the housing; and a second guide for engaging the second channel attached to the vent, wherein the second guide is biased away from the channel.

3. The telescoping downdraft ventilator of claim 2, wherein the channels are on opposite sides of the housing and are parallel to one another, and wherein the two guides are positioned on opposite sides of the vent.

4. The telescoping downdraft ventilator of claim 3, wherein each of the guides is aligned along a line that is one of perpendicular and parallel to the channels.

5. The telescoping downdraft ventilator of claim 4, further comprising a third guide and a fourth guide aligned along a second line that is perpendicular to the channels, wherein the third guide engages the first channel and the fourth guide engages the second channel.

6. The telescoping downdraft ventilator of claim 5, wherein the third guide and the fourth guide are each coupled with a bias element.

7. The telescoping downdraft ventilator of claim 6, wherein the drive assembly comprises a motor operably connected to a shaft;

wherein the rotation of the shaft causes the vent to move with respect to the housing; and wherein the drive assembly is controlled by an electronic control system.

8. The telescoping downdraft ventilator of claim 1 wherein the guide is made of plastic.

9. A telescoping downdraft ventilator comprising:

a housing;

a vent sized to fit within the housing, wherein the vent is biased toward the center of the housing;

a drive assembly for vertically moving the vent with respect to the housing, wherein the drive assembly moves the vent along an axis that is perpendicular to a biasing force applied on the vent;

a pair of parallel channels on opposite sides of the housing; and a pair of guides on opposite sides of the vent, each guide comprising:

a base portion;

at least one pair of raised parallel extensions cantilevered from the base portion such that there is a gap between each raised parallel extension in each pair of raised parallel extensions; and wherein the plurality of raised parallel extensions of each guide extend into a respective one of the pair of parallel channels; and wherein each guide is coupled with a bias element to bias the at least one pair of raised parallel extensions from the vent.

10. A telescoping downdraft ventilator according to claim 9, wherein the guides are aligned along a line that is one of parallel and perpendicular to the channels.

11. A telescoping downdraft ventilator comprising:

a housing having a first channel and a second channel on opposite side panels of the housing, the channels being parallel to one another;

a vent configured to travel along the first and second channel;

a first guide and a second guide attached to opposite sides of the vent, the first guide engaging the first channel and the second guide engaging the second channel, each guide comprising:

a base portion;

an engaging portion comprising at least one pair of raised extensions such that there is a gap between each raised extension in each pair of raised extensions; and at least one biasing element that applies a force to one of the opposite side panels, wherein the at least one biasing element biases the engaging portion away from the channel;

wherein the first guide and second guide are aligned along a line one of parallel and perpendicular to the first channel and the second channel.

12. A telescoping downdraft ventilator according to claim 11, further comprising:

a third guide and a fourth guide attached to opposite sides of the vent and aligned along a line perpendicular to the first channel and the second channel;

wherein the third guide and the fourth guide are each coupled with an engaging portion; and wherein the third guide engages the first channel and the fourth guide engages the second channel.

13. A telescoping downdraft ventilator according to claim 11, wherein the engaging portions center the vent within the housing when driven by a drive assembly.

14. The telescoping downdraft ventilator of claim 1, wherein the engaging portion is oriented perpendicular to the base portion.

15. The telescoping downdraft ventilator of claim 1, wherein the engaging portion engages the channel.

16. The telescoping downdraft ventilator of claim 1, wherein the base portion includes at least one stop.

17. The telescoping downdraft ventilator of claim 9, wherein the base portion of each of the guides includes at least one stop.

18. The telescoping downdraft ventilator of claim 11, wherein the plurality of parallel extensions extends perpendicular from a surface of the base portion.

19. The telescoping downdraft ventilator of claim 11, wherein the engaging portion of the first guide engages the first channel, and wherein the engaging portion of the second guide engages the second channel.

* * * * *